United States Patent [19]

Dorman

[11] 4,320,591

[45] Mar. 23, 1982

[54] FLIP-TYPE PHOTO ALBUM

[75] Inventor: Isidore Dorman, Whitestone, N.Y.

[73] Assignee: NB Jackets Company (a div. of Bell & Howell Co.), Chicago, Ill.

[21] Appl. No.: 775,523

[22] Filed: Mar. 8, 1977

[51] Int. Cl.[3] ..... B42F 17/22; B42F 17/34; G09F 1/10

[52] U.S. Cl. ..... 40/398; 40/391; 40/124; 40/156

[58] Field of Search ..... 40/102, 104, 104.03, 40/104.04, 104.01, 104.09, 104.19, 156, 157, 142 A, 120, 124.2, 530–531, 389–398, 405; 292/251.15; 402/503; 282/46 A

[56] References Cited

U.S. PATENT DOCUMENTS

| | | | |
|---|---|---|---|
| 1,302,849 | 5/1919 | Rand | 40/104.09 X |
| 1,353,846 | 9/1920 | Opsahl | 40/156 |
| 1,614,438 | 1/1927 | Gruhler | 40/391 |
| 1,630,322 | 5/1927 | Wuest | 40/104.06 X |
| 1,885,354 | 11/1932 | Hurley | 40/398 |
| 2,106,856 | 2/1938 | Rorem | 40/400 |
| 2,348,914 | 5/1944 | Lindross | 40/102 |
| 2,403,701 | 7/1945 | Zuber | 40/124.2 |
| 2,638,903 | 5/1953 | Janovsky et al. | 40/398 |
| 3,469,336 | 9/1969 | Halperin | 40/120 X |
| 3,945,140 | 3/1976 | Sullivan et al. | 40/102 |
| 3,956,836 | 5/1976 | Seaborn | 40/53 |

FOREIGN PATENT DOCUMENTS 774664 5/1957 United Kingdom ..... 402/503

*Primary Examiner*—Robert Peshock
*Assistant Examiner*—Michael J. Foycik
*Attorney, Agent, or Firm*—Michael Ebert

[57] ABSTRACT

A flip-type album for protectively storing and displaying photos in an orderly sequence. The album has a pair of front and rear covers which are hinged together, the covers having a tray-like configuration such that when the front cover is superposed over the rear cover, it forms an enclosed box therewith. Each tray-like cover includes parallel side walls whose spacing substantially matches the width of the photos, a series of holes being formed at corresponding positions along the inner surfaces of these walls to define a set of bearings at each position. Supported by the bearing sets are flexible swing bars having a length greater than the width of the photos, the opposing ends of the bars being inserted in the bearing sets by first bowing the bars to shorten the distance between the ends. Each swing bar is constituted by an extruded channel of resilient plastic material having inwardly-biased jaws adapted to receive and clamp onto the upper margins of a photo, whereby the bars serve as hinges for a row of overlapping photos.

3 Claims, 8 Drawing Figures

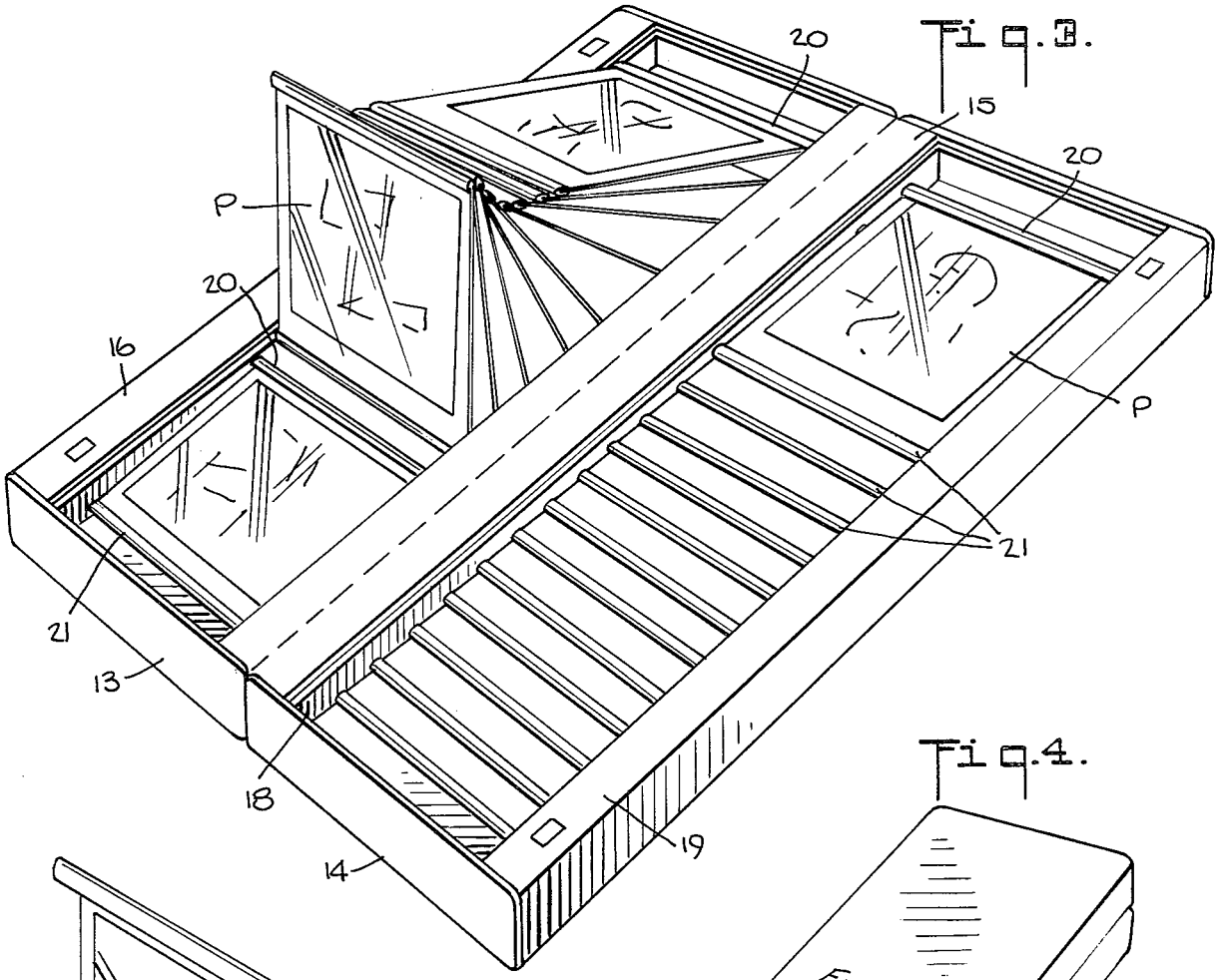
Fig. 3.
Fig. 4.
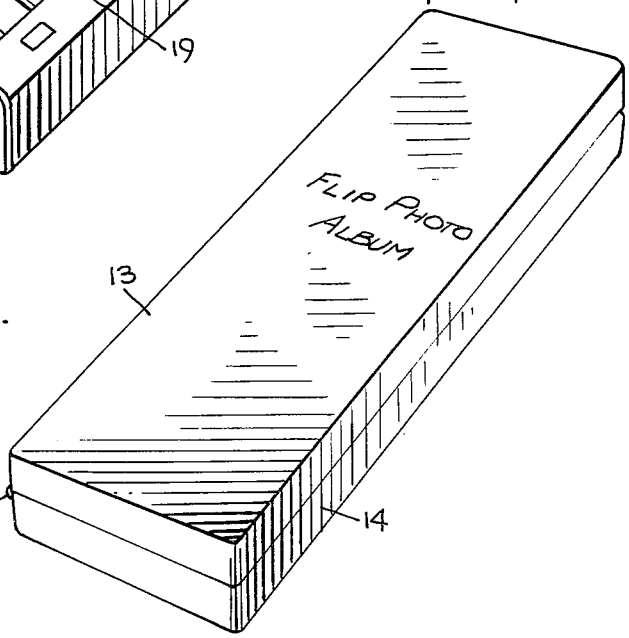
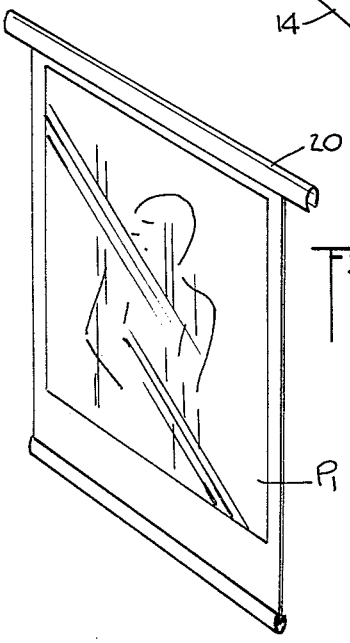
Fig. 7.
Fig. 8.
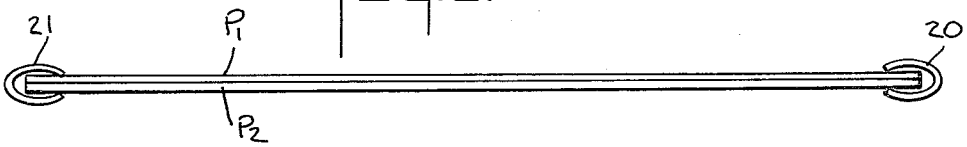

FLIP-TYPE PHOTO ALBUM

BACKGROUND OF INVENTION

This invention relates generally to photo albums of the flip-type, and more particularly to an album in which the photos are directly hinged to the covers of the album to assume a stepped formation.

In order to protectively store photographic prints in an orderly sequence, it is conventional to make use of so-called flip-type photo albums in which the prints are inserted within hinged jackets arranged in two parallel rows, the jackets in each row being progressively stepped. The two rows of hinged jackets are mounted on the inner surfaces of the front and back covers of the album.

In one known form of flip album, each jacket is constituted by a transparent plastic sleeve whose upper margin is hinged by a strip of tape to a baseboard, the sleeve being divided by a paper partition into front and rear compartments for receiving a pair of photo prints in back-to-back relation, such that the front photo in a selected hinged jacket in the stepped row can be seen by raising the jackets which overlap the selected jacket and the rear photo in the same jacket can be seen by flipping over the jacket.

A flip album of this type is relatively costly to fabricate, for it not only involves the production of album covers and jackets, but also requires base boards onto which the sleeves may be hinged by tape at offset positions, the boards thereafter being bonded to the covers. Though the transparent plastic jackets serve to protect the surfaces of the photos inserted therein from scratches and smudges, their inherently glossy finish makes it difficult in some instances to see the prints clearly.

Moreover, in a standard form of flip album, when the album is closed, the two rows of overlapping jackets are sandwiched between the front and rear covers, and the album is then exposed on all sides except for its spine. As a consequence, the album is not sealed and the jackets are not isolated from atmospheric dust and dirt. In time, the jackets become dirty, so that the viewability of the photo stored therein is impaired.

In recent years, Polaroid, Eastman Kodak and other large companies have been marketing cameras which produce "instant" positive photos, rather than negative film that requires printing. Such finished photos are discharged from the camereas in a protective paper mat which frames the picture film and includes a narrow upper margin and a relatively broad lower margin onto which one may apply identifying data. The surface of these instant pictures is such that it is resistant to scratching or smudging and therefore is less in need of a protective sleeve. Yet with flip albums of the type heretofore available, it is still necessary to insert these instant pictures in jackets.

SUMMARY OF INVENTION

In view of the foregoing, it is the main object of this invention to provide a flip-type album in which the photos stored therein are arranged in a stepped row within tray-like front and rear covers, each photo being directly hinged at its upper margin to the side walls of the tray.

More particularly, an object of this invention is to provide a flip album of the above-type in which the side walls of each tray have a series of holes or depressions therein at corresponding positions to define bearing sets, each photo being directly hinged in the tray by a swing bar whose ends are journalled in a bearing set.

A significant feature of the invention resides in the ease with which a flip row of photos may be formed; for all that is necessary is to clamp the swing bar onto the photo and to then bow the bar so that its ends can be inserted within the bearing holes and retained thereby.

Also an object of the invention is to provide an album in which a pair of photos in back-to-back relation are positioned at each step in the row, the upper margins of the photo pair being clamped together by the swing bar and the lower margins thereof being clamped together by a coupling bar.

An important advantage of the flip album in accordance with the invention is that it may be mass-produced at low cost, for the tray-like covers of the album may be injection-molded or vacuum-formed in a one-piece operation. Another advantage of this album is that in its closed state it forms a sealing box in which the photos therein are fully enclosed and protected against atmospheric dust and dirt.

Briefly stated, these objects are accomplished in a flip album for storing a large group of photos of like dimensions, the album's front and rear covers being formed by a pair of complementary trays which are hinged together such that when the covers are superposed, the resultant structure is a closed box.

Each tray includes a pair of parallel side walls, the spacing between the walls substantially matching the width of the photos to be stored therein. Formed along the inner surface of each side wall is a series of depressions or holes, the holes along the walls being at corresponding equi-spaced positions to define bearing sets.

The photos to be stored are clamped at their upper margins by flexible swing bars constituted by plastic material extruded into a channel formation having inwardly-biased resilient jaws which yield when the photo margin is inserted therebetween and then press against the margin, the length of the swing bars exceeding the width of the photos to define ends which are journalled in the side wall bearings.

To install a photo in the tray, it is merely necessary to bow the swing bar to reduce the distance between the ends so that the bar can be interposed between the side walls of the tray and the ends then inserted in the bearing holes, at which point the bar is released to cause it to assume its normal linear form. When a pair of photos in back-to-back relation is hinged by a swing bar clamped on the upper margins of the photos, the photo pair is provided with a coupling bar which is clamped onto the lower margin thereof.

OUTLINE OF DRAWINGS

For a better understanding of the invention as well as other objects and further features thereof, reference is made to the following detailed description to be read in conjunction with the accompanying drawings, wherein:

FIG. 3 is the same as FIG. 2 except that the album is loaded with pictures;

FIG. 4 shows the album in its closed condition;

FIG. 7 illustrates a pair of coupled photos before installation in the album, the photos having a swing bar clamped to the upper margins and a coupling bar clamped to the lower margins; and FIG. 8 is an end view of the coupled photos.

DESCRIPTION OF INVENTION

Figure 1:
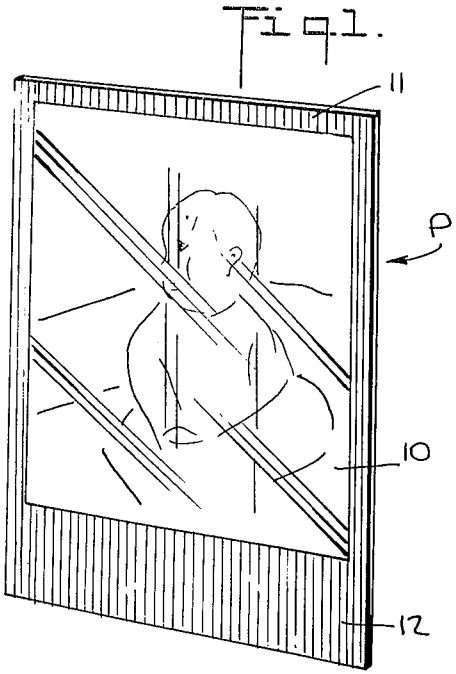
FIG. 1 shows a typical photo of the type which lends itself to storage in a flip album in accordance with the invention.

Referring now to FIG. 1, this shows a typical "instant" photo P of the type for which a flip album in accordance with the invention is particularly suited. It will be seen that photo P is composed of a rectangular film bearing a picture 10 which is framed within a paper mat having a relatively narrow upper margin 11 and a broader lower margin 12. Lower margin 12 serves as an indexing strip onto which one may write or print identifying data.

It is to be understood that while the flip album makes it possible to directly hinge therein pictures of the above-described type for storage and display, in practice the same album may be used with standard pictures that requires a protective transparent jacket. Such jacketed pictures may be hinged into the album by means of swing bars in the same manner as unjacketed pictures of the type shown in FIG. 1.

Figure 2:
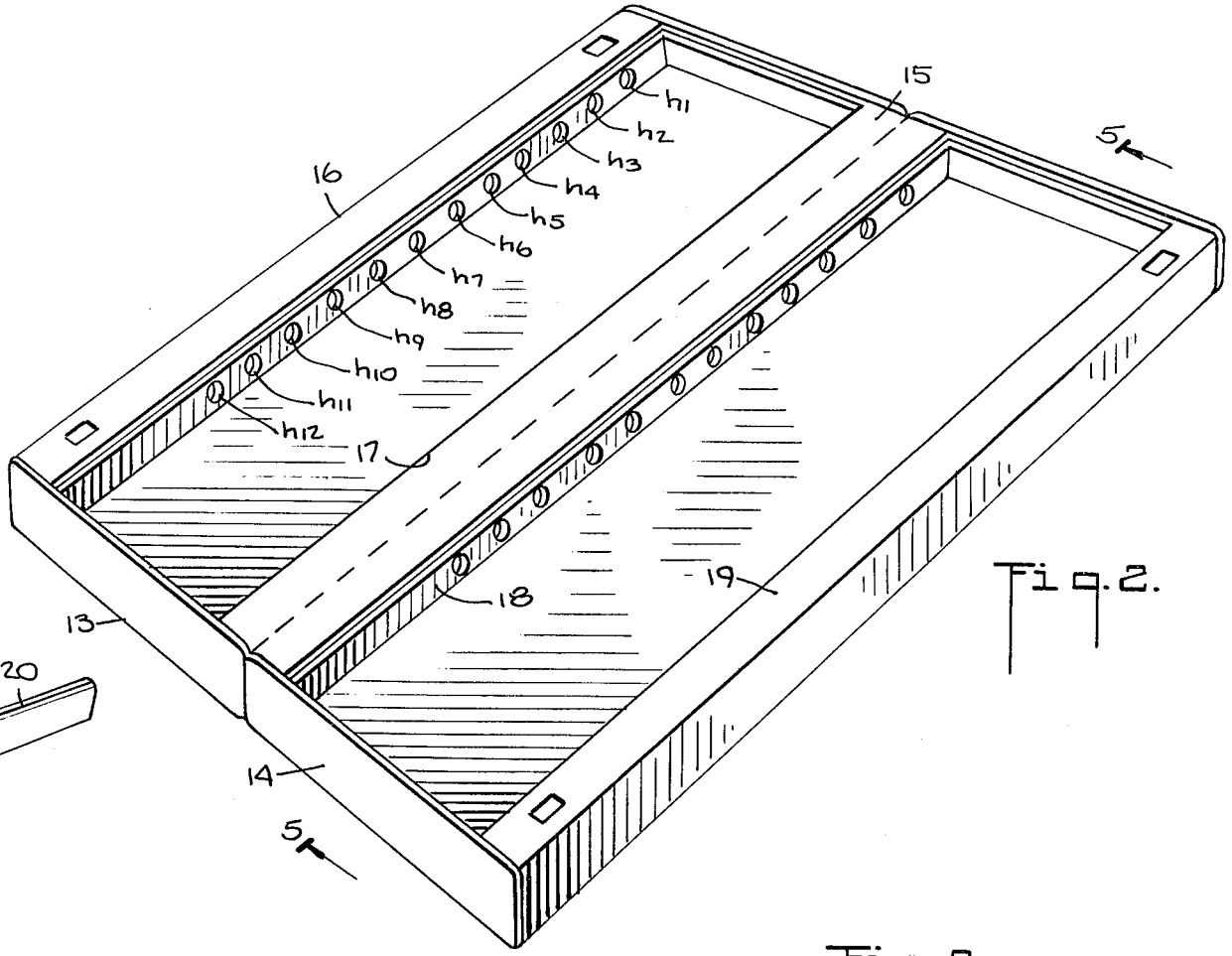
FIG. 2 is a perspective view of the flip album in the open condition but without any pictures therein.

The album, as illustrated in FIGS. 2 and 3, is constituted by complementary front and rear covers 13 and 14 formed of relatively rigid material. The album covers are hinged together by a flexible strip 15. Each cover has a tray-like configuration and includes a pair of parallel side walls 16–17, and 18–19, respectively. The spacing between the side walls substantially matches the width of photos P which are stored therein, all photos having the same standard dimensions, so that the photos may be nested within the cover trays and protected thereby.

When the album is closed and covers 13 and 14 are superposed one over the other, as shown in FIG. 4, the album then assumes the form of a box to seal the photos contained and thereby isolate the photos from atmospheric dust and dirt. In practice, to ensure a protective seal, the covers may be provided with magnetic inserts M embedded in the complementary surfaces of the trays or functionally equivalent releasable locking means, such as Velcro fasteners.

Covers 13 and 14 may be injection-molded of a suitable low-cost synthetic plastic material in a one-piece operation, with hinge 15 taking the form of a living hinge integral with and interconnecting the trays.

Formed along each inner surface of side walls 16 to 19 at corresponding equi-spaced positions is a series of depressions or holes $h_1$ to $h_{12}$ to define bearing sets. The spacing between the holes is such that when photos P are hinged on these bearing sets in the front and rear covers, the photos in the resultant row thereof overlap and are progressively stepped to define a visible index in which lower margins 12 are exposed so that the data on these margins is readable.

Figure 6:
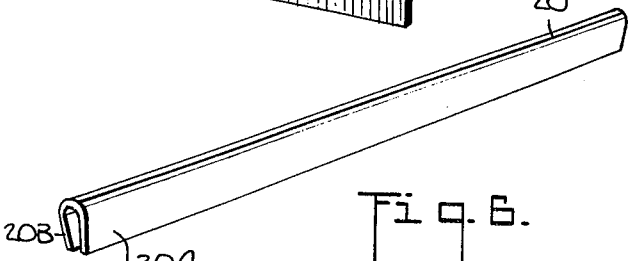
FIG. 6 is a perspective view of one swing bar.
Figure 5:
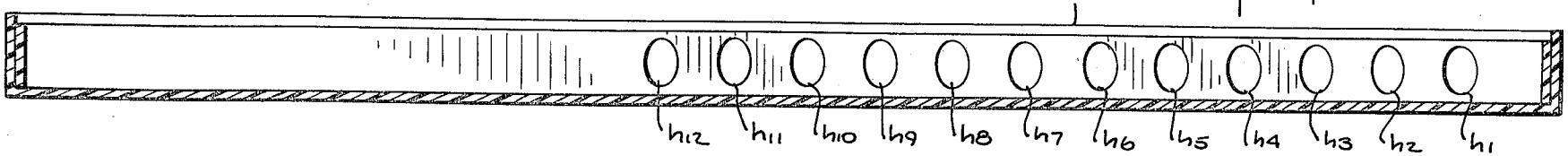
FIG. 5 is a section taken in the plane indicated by lines 5—5 in FIG. 2.

In order to hinge photos P in the album trays, the upper margin of each photo is secured to a swing bar 20, shown separately in FIG. 6. Bar 20 takes the form of an extruded channel of flexible synthetic plastic material having a U-formation to define a pair of resilient jaws 20A and 20B which are inwardly biased.

A photo or pair of photos P may be inserted into swing bar 20 in the endwise direction. The upper margin or margins of the photos cause the jaws to yield to make room therefor, the jaws pressing against and clamping the margins. The bar may be formed by composite layers of plastic material to afford durability and strength. Alternatively, the bar may be provided with a central core of metal foil laminated to inner and outer plies. In practice, the outer ply may include pigmentation. Thus in the case of a bar having aluminum foil in its central core and an amber-colored outer ply, the bar then presents a gold-like appearance.

The length of bar 20 exceeds the width of photo P so that the opposing ends of the bar extend beyond the upper margin of the photo. Since the bar is longer than the spacing between the side walls of the tray, in order to insert the bar ends in a selected bearing set, the bar and the photo clamped thereto must be bowed to permit entry of the bar ends into the holes of the bearing set, after which the bar is released to assume its normal linear form, the ends of the bar then being retained in the holes. The bar material must therefore possess sufficient memory so that it will not be permanently deformed when bowed.

When swing bar 20 is used to clamp onto a pair of photos $P_1$ and $P_2$, as shown in FIGS. 7 and 8, which are in back-to-back relation, then to maintain the photo couple, a coupling bar 21 is provided which is clamped onto the lower margins. The coupling bar is similar to a swing bar except that it is shorter, so that its length matches the width of the photos and there are no projecting ends.

While there has been shown and described a preferred embodiment of a flip-type photo album in accordance with the invention, it will be appreciated that many changes and modifications may be made therein without, however, departing from the essential spirit thereof. Thus instead of injection molding the album, it can be vacuum formed; and instead of a magnetic lock, the album covers can be held together by a plastic snap latch whose components are integral with the covers.

I claim:

1. A flip-type photo album for storing and displaying a group of photos of like dimensions, the photos being stored in pairs in back-to-back relation, each photo being constituted by a rectangular film bearing a picture which is framed within a mat having an upper margin and a broader lower margin, said album comprising:

A complementary interhinged front and rear covers having a tray-like configuration for accommodating the photos such that when the album is closed and the covers are superposed, the resultant structure is a box enclosing the photos and isolating the photos from atmospheric dust and dirt, said trays being formed of rigid plastic material interconnected by a living hinge, each tray having a pair of side walls whose spacing substantially matches the width of the photos, the inner surfaces of the side walls having a series of holes therein at equi-spaced corresponding positions to define bearing sets;

B swing bars for hinging each back-to-back pair of said photos from said bearing sets in a progressively stepped row, each bar being formed from flexible material having a linear channel formation which is uniform throughout the length thereof defining a pair of inwardly-biased resilient jaws which are yieldable when the upper margins of the photo pair are inserted therebetween and which press and clamp onto said upper margin, said bars having a length greater than the width of the photos to provide projecting ends which are receivable in a bearing set by bowing the flexible bar and then releasing it to cause the bar to assume its normal linear form; and C coupling bars having the same construction as said swing bars but of shorter length, said coupling bars engaging the lower margins of each photo pair.

2. An album as set forth in claim 1, wherein said swing bars are formed of extruded synthetic plastic material.

3. An album as set forth in claim 1, wherein said swing bars are formed of metal foil having inner and outer plastic plies laminated thereto.

* * * * *